US008324590B2

(12) United States Patent
Renftle et al.

(10) Patent No.: US 8,324,590 B2
(45) Date of Patent: Dec. 4, 2012

(54) CHOPPER FOR A PARTICLE BEAM

(75) Inventors: Walter Renftle, Dueren (DE); Hans Kaemmerling, Eschweiler (DE); Michael Prager, Juelich (DE); Magdalena Prager, legal representative, Juelich (DE)

(73) Assignee: Forschungszentrum Juelich GmbH, Juelich (DE)

( * ) Notice: Subject to any disclaimer, the term of this patent is extended or adjusted under 35 U.S.C. 154(b) by 264 days.

(21) Appl. No.: 12/733,496

(22) PCT Filed: Sep. 12, 2008

(86) PCT No.: PCT/DE2008/001539

§ 371 (c)(1),
(2), (4) Date: Apr. 26, 2010

(87) PCT Pub. No.: WO2009/039832

PCT Pub. Date: Apr. 2, 2009

(65) Prior Publication Data

US 2010/0294959 A1 Nov. 25, 2010

(30) Foreign Application Priority Data

Sep. 28, 2007 (DE) ..... 10 2007 046 739

(51) Int. Cl.
*H01J 1/46* (2006.01)

(52) U.S. Cl. ..... 250/396 R; 313/348; 313/369; 313/166; 313/237; 313/338

(58) Field of Classification Search ..... 600/411, 600/407, 415; 376/112; 250/396 R
See application file for complete search history.

(56) References Cited

U.S. PATENT DOCUMENTS

| | | | | |
|---|---|---|---|---|
| 4,112,306 | A * | 9/1978 | Nunan | 376/112 |
| 4,139,777 | A * | 2/1979 | Rautenbach | 376/112 |
| 6,028,691 | A | 2/2000 | Doster | |
| 6,683,426 | B1 * | 1/2004 | Kleeven | 315/502 |
| 7,907,987 | B2 * | 3/2011 | Dempsey | 600/411 |
| 7,937,131 | B2 * | 5/2011 | Cho et al. | 600/415 |
| 2005/0197564 | A1 * | 9/2005 | Dempsey | 600/411 |
| 2006/0052685 | A1 * | 3/2006 | Cho et al. | 600/407 |
| 2008/0247515 | A1 | 10/2008 | Probst et al. | |
| 2009/0149735 | A1 * | 6/2009 | Fallone et al. | 600/411 |

FOREIGN PATENT DOCUMENTS

| | | |
|---|---|---|
| CN | 2742535 | 11/2005 |
| DE | 38 44 563 | 11/1989 |
| DE | 10 2004 002 326 | 8/2005 |
| WO | WO-2005/068988 | 7/2005 |

* cited by examiner

*Primary Examiner* — Nikita Wells
*Assistant Examiner* — Johnnie L Smith
(74) *Attorney, Agent, or Firm* — Jordan and Hamburg LLP

(57) ABSTRACT

A chopper for a particle beam comprises an annular guiding element and an element for controlling the intensity of the particle beam. The control element is supported on the guiding element so that at least one point under consideration on the control element can revolve along the circumference of the guiding element. Mounting along a circumference allows for accommodation of considerably higher disturbance torque than mounting on a rotational axle, using the same bearing force. Furthermore, it is possible to dispense with the entire rotational axle, and the control element can be designed, for example, as a ring. This brings about considerable weight savings as compared to chopper wheels according to the prior art, which accordingly enables higher circumferential speeds and therefore higher modulation frequencies for the particle beam, while at the same time increasing operational safety.

19 Claims, 4 Drawing Sheets

CHOPPER FOR A PARTICLE BEAM

The invention relates to a chopper for a particle beam.

BACKGROUND OF THE INVENTION

Choppers are used to divide a continuous particle beam into spatially and temporally delimited pulses. A chopper is an element which comprises both regions that allow the particle beam to pass and regions that block the particle beam. As the chopper is moved through the particle beam, the open and blocked regions pass alternatingly through the particle beam, thereby modulating the particle beam.

Choppers configured as wheels, which are rotated through the particle beam, are known from DE 10 2004 002 326 A1. An essential aspect of the performance of such a chopper is the maximum frequency with which it can modulate the particle beam. This frequency is determined by the circumferential speed at the edge of the chopper wheel, which in turn is defined by the diameter and the rotational speed.

The aforementioned published prior art discloses that circumferential speeds of approximately 300 m/s are required for typical experiments. The published prior art discloses choppers which are designed as solid disks, as well as choppers segmented in a spoked manner in order to achieve such circumferential speeds.

The disadvantage is that the material of the chopper wheels is stressed to the limits of its mechanical strength, due to centrifugal forces. In addition, chopper wheels may oscillate. In practical applications, speed ranges in which the natural frequencies of the chopper wheels may be excited must be avoided. As a result, it is possible that the chopper cannot even be operated at a circumferential speed which it would be capable of, based on the mechanical strength thereof.

SUMMARY OF THE INVENTION

It is therefore an object of the invention to provide a chopper that can modulate a particle beam using a higher frequency than was previously possible and which can also be operated more safely than choppers according to the prior art.

Within the scope of the invention, a chopper for a particle beam was developed. This chopper is characterized by at least one annular, and particularly circular, ring-shaped, guiding element and by at least one element for controlling the particle beam, which is supported on the guiding element so that at least one point under consideration on the control element can revolve along a circumference of the guiding element.

A guiding element as defined by the present invention shall be understood as an element which imparts one or more constraints on the motion of the control element. As a result, the guiding element should be designed, and/or fixed in space, at least so that the motion of the control element during operation of the chopper does not solicit any motion in the guide element.

A control element as defined by the present invention shall be understood as any element which comprises at least one region capable of diminishing the intensity of the particle beam. This region can in particular completely block the particle beam. If the control element is moved through the particle beam, the intensity of the particle beam can be modulated.

It was found that the measures according to the invention provide, for the first time, an alternative to choppers that have heretofore always been configured as wheels. In this way, undesirable oscillations which, until now, had necessarily occurred due to the wheel-shaped design, are advantageously avoided. As a result, a chopper is provided which can modulate the particle beam using a considerably higher frequency than was possible according to the prior art. The mounting according to the invention along a circumference is, however, also functional and advantageous for rotational frequencies of the point under consideration on the control element along the circumference of the guide element, which are below the maximum circumferential frequency possible.

In addition, it was realized that the mounting according to the invention along a circumference is considerably more stable, particularly with larger circumferences and higher circumferential speeds, than the mounting on a rotational axle, which is necessary with wheel-shaped choppers according to the prior art. In order to compensate for a given disturbance torque, according to the definition of the torque, a mounting along a circumference requires a much lower force than a mounting on a rotational axis. At the same time, the bearing force to be applied can be distributed over the entire circumference of the guiding element so that higher overall bearing forces can be exerted on the control element. As a result, the guiding element can have a larger circumference and, at the same time, the control element can be moved more quickly. In this way, the control element can move with a higher circumferential speed. The result is that the particle beam can be modulated using a higher frequency than was possible according to the prior art.

The invention also expressly includes a chopper wheel as the control element, which can be designed as a solid disk or in a spoked segmented manner, and a mounting on a rotational axis may also be provided. In this way, an existing chopper can be retrofitted with the mounting along a circumference according to the invention. The advantages according to the invention then likewise apply, according to which the mounting along the circumference requires a lower force than the mounting on a rotational axis in order to accommodate a given disturbance torque, and overall higher bearing forces can be exerted on the control element.

Since the control element according to the invention is supported close to the location of the function thereof, the leverage by which disturbance torque can act on the bearing is advantageously reduced. In this way, a given disturbance torque acts on the bearing with a lower force than in the case of a mounting on a rotational axis according to the prior art. This reduces the risk of destroying the bearing and allowing the control element, or parts thereof, to fly out in an uncontrolled manner, for example if the motion of the control element is abruptly stopped by a foreign object.

It is further possible to entirely dispense with a rotational axle. As a result, there is no need to mechanically connect parts of the control element to a rotational axle. A variety of designs can therefore be used for the control element. For example, it can have an annular, and particularly circular, ring-shaped, design. The control element can, in particular, be disposed concentrically with the guiding element. The effect on the particle beam, however, can already be achieved using a single control element which is just large enough to diminish the particle beam at a point of the revolution around the circumference of the guiding element. Using a plurality of such single control elements, a control element can be assembled which, as a unit, can revolve around the circumference of the guiding element. This control element can, for example, occupy all of or part of the circumference of the guiding element. In the event of defects, such as radiation damage due to interaction with the particle beam, the single control elements can be replaced independently of each other. The connection of the single control elements can be elastic or rigid.

Such control element designs can have a considerably lower weight than chopper wheels according to the prior art. In addition, this weight will increase a purely linear fashion with the circumference of the control element. Since the circumferential speed, which determines the maximum achievable modulation frequency, is the product of the rotational speed and circumference, it is advantageous to design the control element so that it has the largest circumference possible. In contrast, in the case of a (solid) chopper wheel according to the prior art, the weight is proportional to the surface and thus increases quadratically with the circumference. The significantly lower weight according to the invention, in turn, means that a higher circumferential speed and thus a higher modulation frequency can be achieved per unit of bearing force, which can be exerted onto the control element.

The lower weight improves the operational safety of the chopper in two ways: it causes less stress on the control element by the centrifugal forces, thereby reducing the risk of fragmentation. In the unlikely case that it does fragment, the fragments will also have a considerably lower weight and kinetic energy, and thus an enclosure serving to protect the surroundings from such fragments requires considerably less expenditure.

At the same time, the lower weight also increases the natural frequencies of the control element so that they are advantageously no longer in the range of the circumferential frequencies around the circumference of the guiding element.

When operating the chopper in a vacuum, an annular design for the control element provides another advantageous effect. Only the guiding element and the control element must be located in the vacuum, but not the entire region defined by these elements. It is therefore sufficient if a tubular region is kept under vacuum conditions, enclosing the control and guiding elements. This region can, in particular, be disposed between an inside diameter, which is smaller than the inside diameter of the control element, and an outside diameter, which is larger than the outside diameter of the guiding element. This drastically reduces the volume to be maintained under vacuum conditions. Thus, the expenditure for pump capacity and time for producing this vacuum are reduced considerably.

The annular shape of the guiding element is not limited to a circular ring shape according to the invention. Other annular configurations, such as ellipses, can be advantageous, for example, if the chopper must be adapted to the spatially constrained conditions of an existing test arrangement.

In a particularly advantageous embodiment of the invention, the control element comprises at least one region which reflects the particle beam. To this end, a graphite monocrystal is, for example, suitable for a neutron beam. The portion of the particle beam that is not allowed to pass by the chopper can then be used for another experiment. However, the portion can also be conducted through an additional chopper. If both parts of the particle beam are combined, the result is modulated with a higher frequency than would be possible with a single chopper.

In a further advantageous embodiment of the invention, the control element comprises at least one helical bore. At a given circumferential speed, only particles within a narrow speed window can pass through the control element. The chopper in this case not only modulates the intensity of the particles but, at the same time, selects the particles of the beam according to the speed thereof, and therefore according to the energy and pulse thereof. In this way, the chopper and speed selector are advantageously combined in one unit. As only one drive is required, such a combination unit is more reliable than two single units. At the same time, this design saves installation space, which is particularly advantageous in spatially constrained test arrangements and when operating in a vacuum.

The longer the helical bore is, the narrower is the speed range of the particles that can pass through it. However, a longer bore increases the thickness and therefore the weight of the control element. As great weight savings are achieved elsewhere on the control element according to the invention, it is possible to design the region of the helical bore thicker, without detracting from stability.

It is conceivable that the control element be supported on the guiding element so that the point under consideration can revolve along the outer circumference of the guiding element. In a particularly advantageous embodiment of the invention, however, the control element is supported against the guiding element such that the point under consideration can revolve along the inner circumference of the guide element. In this embodiment, the control element is pushed against the guiding element during operation by the centrifugal forces. This increases the stability of the mounting and the operational safety at the same time: even if the control element should break, the guiding element prevents the fragments from flying out radially. A separate, complex enclosure is not required for the chopper in order to protect the surroundings from fragments. The guiding element already increases the operational safety.

In a particularly advantageous embodiment, the mounting of the control element on the guiding element is a magnetic mounting, and is, in particular, a permanent-magnetic mounting. Such a mounting is contact-free and therefore wear-free, even at high rotational speeds. No lubricant whatsoever is required, thereby making the bearing suitable for ultra high vacuum conditions without restrictions.

Advantageously, the guiding element and the control element comprise at least one magnetized region such that these magnetized regions repel each other at the point of revolution of the point under consideration at which they come closest to each other. If the control element has a circular ring-shaped design, for example, and the magnetized regions are disposed point-symmetrically around the center of the ring, a rest position is defined, in which all repulsions between magnetized regions offset each other. In the course of travel out of the rest position, a magnetic gap is reduced, so that the repelling force between the corresponding magnetized regions increases and drives the control element back into the rest position.

In a further advantageous embodiment, the mounting of the control element is constrained so that the control element can neither move axially out of the guiding element nor cant therein. This can be achieved, for example, by additional magnetized regions on the control element and on the guiding element, which exert magnetic forces having an axial component on each other when they directly oppose each other during operation.

In a particularly advantageous embodiment of the invention, the guiding element comprises means for generating a travelling magnetic field. In addition to the magnetic mounting, the control element can thus also be driven via the guiding element. This functional integration of the drive and mounting can also counter imbalances in the control element, with the strength of the travelling magnetic field being adapted as a function of time. Such imbalances are very difficult to avoid in choppers having typical diameters of 1.20 m and greater and circumferential speeds of 300 m/s.

In an advantageous embodiment of the invention, a region of the guiding element which is magnetized at least intermittently, or permanently, and which is part of the magnetic mounting of the control element on the guiding element, is also an element for generating the travelling magnetic field. If the magnetized region is a coil, for example, which is energized according to a time schedule for the magnetic mounting of the control element, then an additional current, which generates the travelling magnetic field, can be modulated on this current.

In order to achieve maximum drive, and therefore a maximum circumferential speed, the travelling magnetic field is advantageously disposed vertically on the magnetic field of the magnetic mounting.

The teaching underlying the above explanations is not limited to the chopper application that is described in detail. Instead, the general teaching is that it is advantageous to design a preferably magnetic mounting of two components which, in particular, can be rotated relative to each other, in such a way that at least one point under consideration on the first component can revolve along a circumference of the second component, this second component advantageously having an annular shape. The advantages according to the invention of such an arrangement also take effect, for example, with the magnetic mounting of turbomolecular pumps or exhaust gas turbochargers.

On a general note, the approach makes it possible to modify elements, which according to the prior art rotated about a rotational axle, and which have a physical effect in the region of the outer circumference thereof, so that the element is supported along the outer circumference. In this way, the rotational axle and connections, whichever form they may take on, between this rotational axle and the outer circumference, can be partially or completely eliminated. As a result, the weight of the arrangement can be advantageously reduced, and the leverage, whereby disturbance torque acts on the bearing, is advantageously reduced. The outer circumference can be tailored as needed. For example, it may be a closed loop, which can be oriented arbitrarily in the space, for example in a vertical plane. The bearing carries the element producing the physical effect, such as one or more turbine blades, beam stoppers, filters, reflectors, or energy selectors.

In particular, turbomolecular pumps and exhaust gas turbochargers are characterized by particularly high disturbance torque, which acts with great leverage on the bearing in a magnetic mounting on an axle according to the prior art. With the mounting along a circumference according to the invention, this disturbance torque acts with only very little leverage and can therefore be better compensated for by the bearing. The bearing force is distributed across the entire circumference of the second component so that, according to the overall invention, considerably higher bearing forces can be absorbed than according to the prior art. In addition, the installed size of both turbomolecular pumps and exhaust gas turbochargers can advantageously be reduced by the claimed integration of the drive and mounting.

Below, the subject matter of the invention will be described in more detail based on figures, without thereby limiting the subject matter of the invention.

DESCRIPTION OF THE PREFERRED EMBODIMENTS

Figure 1:
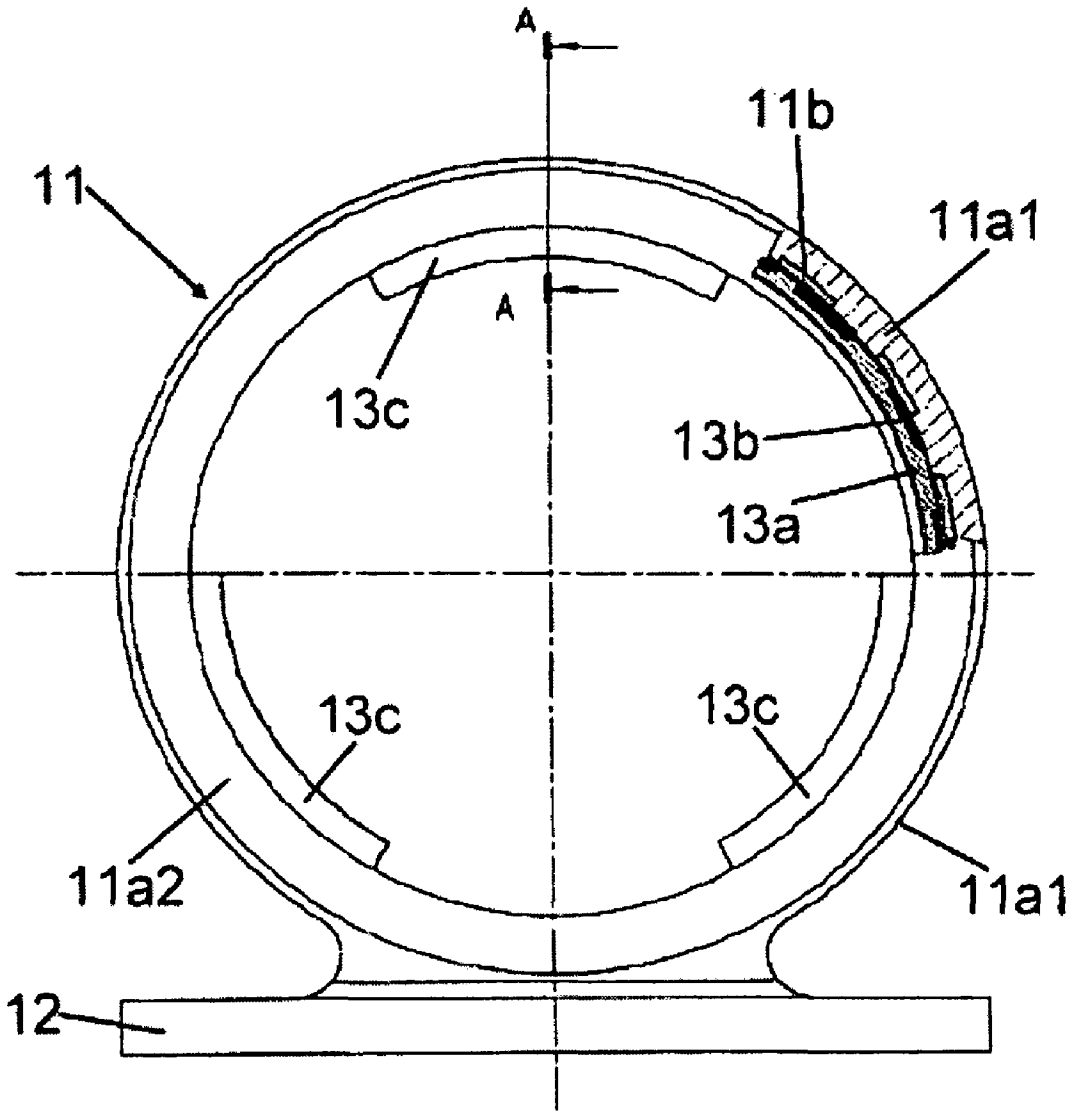
FIG. 1: Embodiment shows one embodiment of the chopper according to the invention as viewed along an axis of symmetry thereof.

Like reference numerals in each case denote like acting elements.

FIG. 1 shows an embodiment of a chopper according to the invention in a view along the axis of symmetry thereof (the axis of symmetry is located vertically on the drawing plane). This chopper comprises a circular ring-shaped guiding element 11 on a base 12 and a likewise circular ring-shaped control element 13 disposed concentrically with the guiding element 11. The guiding element 11 comprises a main body 11*a* and magnetic coils 11*b*. The main body 11*a* is composed of a circular ring 11*a*1, which is disposed between two circular ring disks 11*a*2 and 11*a*3. The magnetic coils 11*b* are sunk into the inside of the circular ring 11*a*1 of the main body 11*a* at regular intervals.

The control element 13 comprises a main ring 13*a*, permanent-magnetic regions 13*b*, and blocking regions 13*c* for reflecting the particle beam. The permanent-magnetic regions 13*b* are sunk into the outside of the main ring 13*a* at regular intervals. The blocking regions 13*c*, for reflecting the particle beam, are installed on the inside of the main ring 13*a* at regular intervals.

The magnetic coils 11*b* and the permanent-magnetic regions 13*b* interact so that the control element 13 is supported magnetically on the guiding element 11. At the same time, the magnetic coils 11*b* are also elements for generating a travelling magnetic field, by which the control element 13, and thus the regions 13*c* for reflecting the particle beam, can be rotated inside the guiding element 11.

The main body 11*a* surrounds the main ring 13*a* almost completely, except for a radially inwardly directed region, in which the regions 13*c* for reflecting the particle beam can protrude radially inward in every rotational position of the control element 13 around the guiding element 11. In this way, the magnetic mounting of the control element 13 on the guiding element 11 is supplemented with a mechanical emergency mounting, which imparts constraints on the control element 13 such that it can neither move axially out of the guiding element 11 nor cant therein.

The embedding of the magnetic coils 11*b* in the main body 11*a*, and the embedding of the magnetized regions 13*b* in the main ring 13*a*, are only visible in the upper right quadrant of FIG. 1, in which the chopper is shown in a partially cutaway view.

Figure 2:
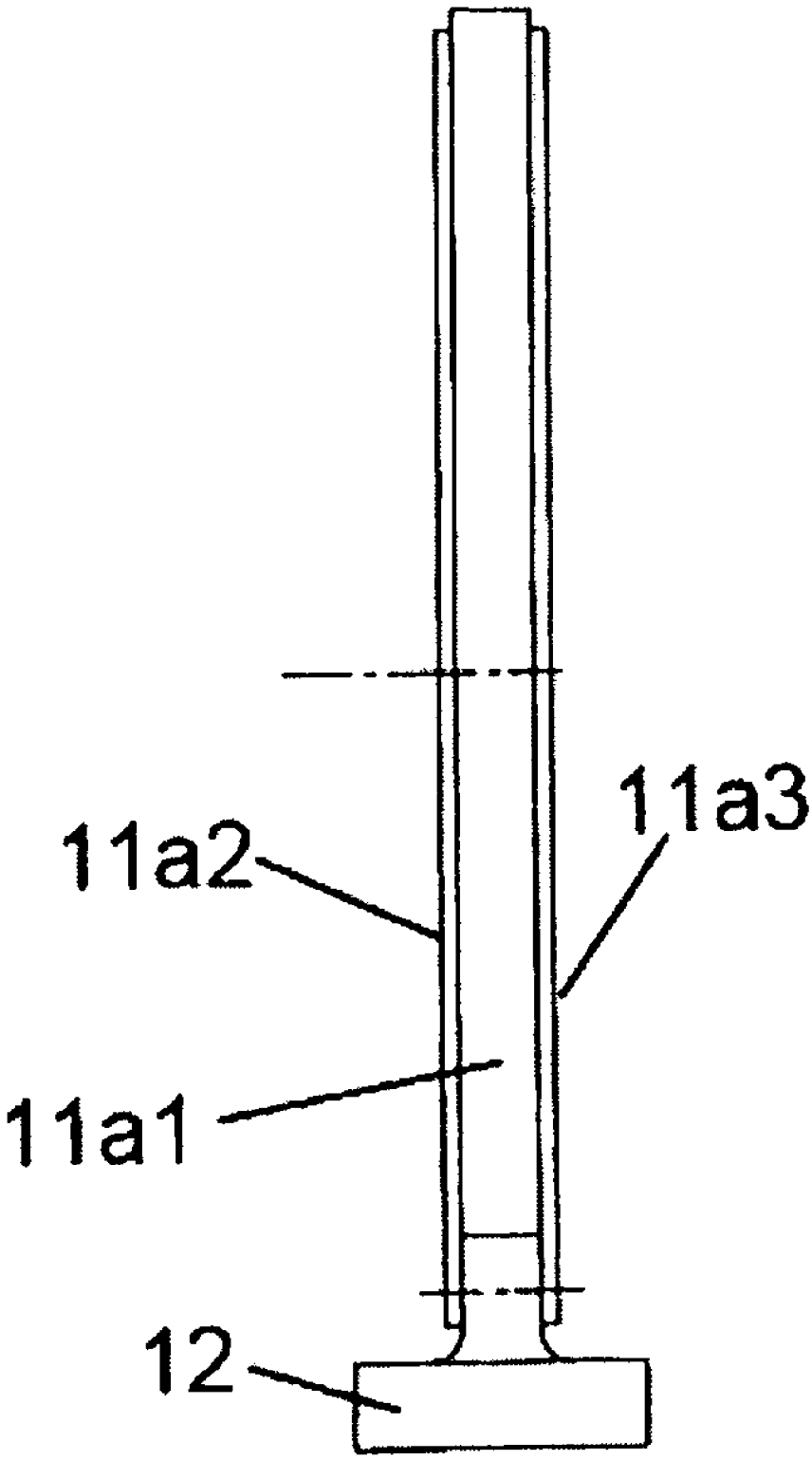
FIG. 2: is a side view of the chopper from of FIG. 1.

FIG. 2 shows a side view of the chopper in FIG. 1. The chopper here is rotated 90° out of the drawing plane, as compared to FIG. 1. This illustrates the division of the main body 11*a* into a circular ring 11*a*1 and two circular ring disks 11*a*2 and 11*a*3.

Figure 3:
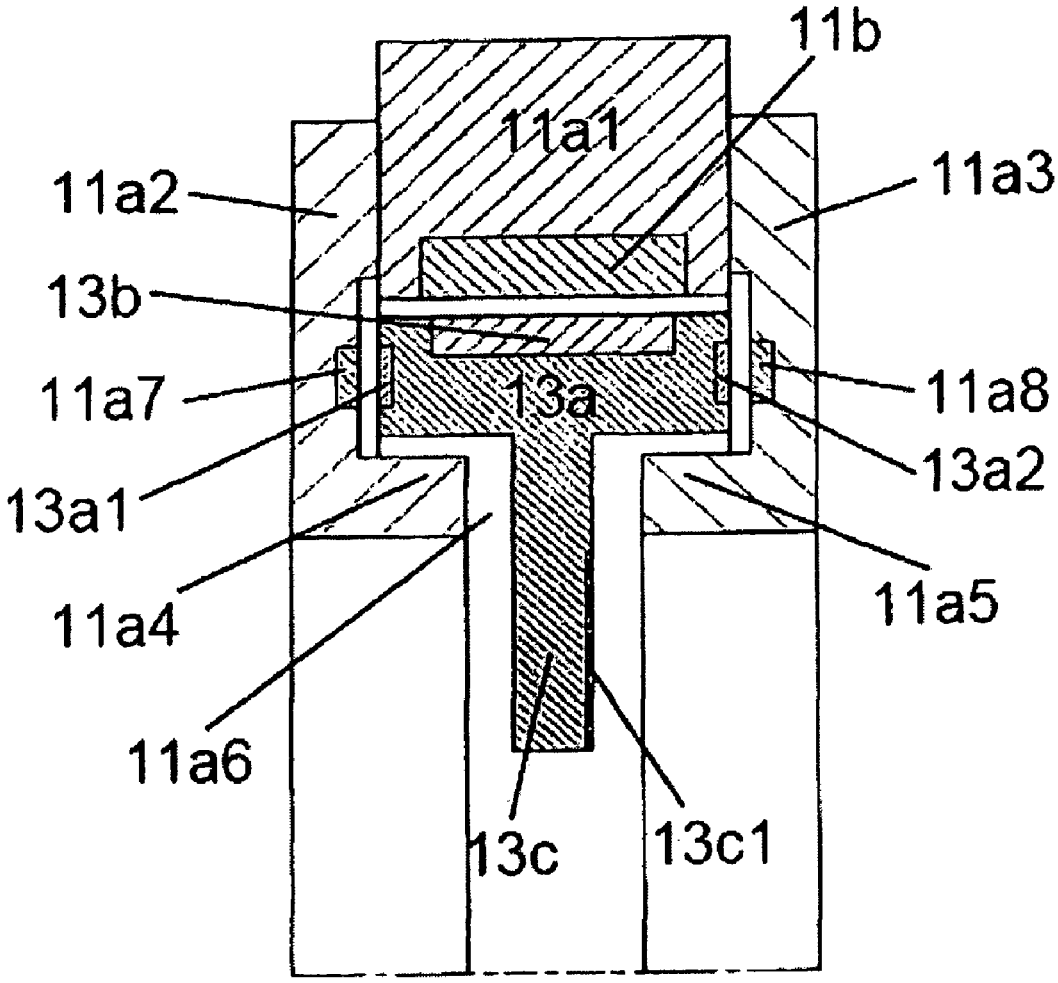
FIG. 3: is a sectional view of the chopper ion of FIG. 1.

FIG. 3 shows a sectional view of the chopper, sectioned along line A-A in FIG. 1. At the edge directed toward the common axis of symmetry of the guiding element 11 and control element 13, the circular ring disks 11*a*2 and 11*a*3 of the main body 11*a* have extensions 11*a*4 and 11*a*5, which are directed toward each other. The extensions 11*a*4 and 11*a*5 form a gap 11*a*6, in which the region 13*c* of the control element for reflecting the particle beam engages, and in which this region 13*c* can revolve.

Additional magnetized regions 11*a*7 and 11*a*8 are sunk into the edges of the circular ring disks 11*a*2 and 11*a*3, oriented in the direction of the main ring 13*a* of the control element 13. Magnetized regions 13*a*1 and 13*a*2 are sunk into the edges of the main ring 13*a* of the control element 13, which are oriented toward these regions 11*a*7 and 11*a*8. The magnetized regions 11*a*7 and 11*a*8 in the circular ring disks interact with the magnetized regions 13*a*1 and 13*a*2 of the main ring so that the circular ring disks 11*a*2 and 11*a*3 interact with the main ring 13*a* by way of axial magnetic forces—the term "axial" relating here to the common axis of symmetry of the guiding element 11 and control element 13. In this way, the magnetic mounting of the control element 13 against the guiding element 11 is constrained so that the control element 13 can neither move axially out of the guiding element 11 nor cant therein. The mechanical emergency mounting mentioned above only comes into play in extraordinary operating states, which prove to be too much for the magnetic mounting as a result of the interaction between the magnetized regions 11*a*7 and 11*a*8 and the magnetized regions 13*a*1 and 13*a*2.

The magnetized region 13*b*, which is sunk into the main ring 13*a* of the control element, forms a magnetic gap with the magnetic coil 11*b*. The magnetized region 11*a*7 forms a magnetic gap with the magnetized region 13*a*1. The magnetized region 11*a*8 forms a magnetic gap with the magnetized region 13*a*2.

The blocking region 13*c* for reflecting the particle beam is endowed with reflective properties by way of a coating 13*c*1 applied on one side.

In the embodiment shown in FIG. 3, the magnetized regions 13*b*, which are optionally sunk into the main ring 13*a* of the control element, can be additionally secured by a layer or a winding composed of high-strength material (such as CFIC or a woven fabric), preventing a radially outwardly oriented motion of the magnetized regions 13*b* out of the main ring 13*a*. During operation, the centrifugal force acts in this direction on the magnetized regions 13*b*, and the centrifugal force may be significant because permanent-magnetic materials typically have high density.

Figure 4:
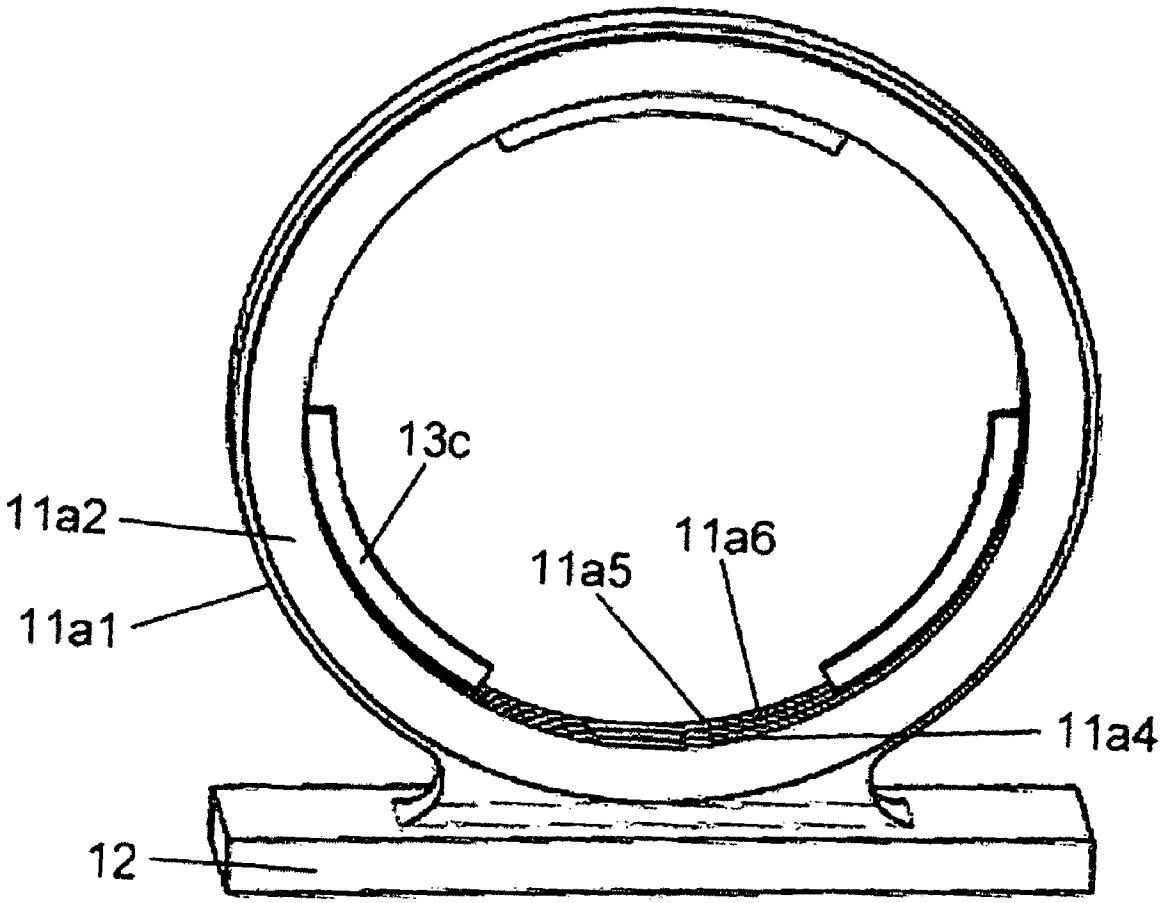
FIG. 4: is a three-dimensional view of the chopper of FIG. 1.

FIG. 4 shows the chopper in a three-dimensional illustration. It is particularly clearly apparent that, during operation, the regions 13*c* for reflecting the particle beam revolve inside the gap 11*a*6 between the extensions 11*a*4 and 11*a*5 of the circular ring disks 11*a*2 and 11*a*3 of the main body 11*a* of the guiding element 11.

The invention claimed is:

1. A chopper that modulates a particle beam into spatially and temporally delimited pulses, the chopper comprising at least one annular guiding element and at least one control element which is supported on the guiding element so that at least one point under consideration on the control element can revolve along a circumference of the guiding element, wherein the control element modulates the particle beam based on a configuration of the control element and at least a frequency with which said at least one point under consideration revolves along said circumference.

2. The chopper according to claim 1, wherein the guiding element is a circular ring-shaped guiding element.

3. A chopper according to claim 1, wherein the control element comprises a chopper wheel.

4. A chopper according to 1, wherein the control element is an annular control element.

5. A chopper according to claim 1, wherein the control element comprises at least one region for reflecting the particle beam.

6. A chopper according to claim 1, wherein the control element comprises at least one helical bore.

7. A chopper according to claim 1, wherein the particle beam is a neutron beam.

8. A chopper according to claim 1, wherein the control element is mounted so that the point under consideration can revolve along the inner circumference of the guiding element.

9. A chopper according to claim 1, comprising a magnetic mounting for mounting the control element on the guiding element.

10. A chopper according to claim 9, wherein the guiding element and the control element each comprise at least one magnetized region such that these magnetized regions repel each other at the point of revolution of the point under consideration at which they come closest to each other.

11. A chopper according to claim 9, wherein the magnetic mounting is constrained so that the control element can neither move axially out of the guiding element nor cant therein.

12. A chopper according to claim 9, wherein the guiding element comprises means for generating a traveling magnetic field.

13. A chopper according to claim 12, comprising means for imparting a time dependence to the traveling magnetic field.

14. A chopper according to claim 12, wherein at least one region of the guiding element is magnetized intermittently or permanently, and is part of the magnetic mounting of the control element on the guiding element and is also an element for generating the traveling magnetic field.

15. A chopper according to claim 12, wherein traveling magnetic field is located vertically on the field of magnetic mounting.

16. A chopper according to claim 1, wherein the control element is a circular ring-shaped control element.

17. A chopper according to claim 6, wherein length of said at least one helical bore determines a range of speed of particles in the particle beam that are output from the chopper as said pulses.

18. A chopper that modulates a particle beam into spatially and temporally delimited pulses, the chopper comprising:

a stationary annular guiding element; and a movable control element that revolves along a circumference of the guiding element; and wherein the control element moves through the particle beam to modulate the particle beam based on a configuration of the control element and at least a frequency with which said control element revolves along said circumference.

19. A chopper according to claim 18, wherein the control element comprises at least one helical bore; and wherein length of said at least one helical bore determines a range of speed of particles in the particle beam that are output from the chopper as said pulses.

* * * * *